US010458175B2

(12) United States Patent
Degelsegger

(10) Patent No.: US 10,458,175 B2
(45) Date of Patent: Oct. 29, 2019

(54) DEVICE FOR CLOSING AN OPENING IN A BUILDING

(71) Applicant: Walter Degelsegger, Desselbrunn (AT)

(72) Inventor: Walter Degelsegger, Desselbrunn (AT)

( * ) Notice: Subject to any disclaimer, the term of this patent is extended or adjusted under 35 U.S.C. 154(b) by 0 days.

(21) Appl. No.: 15/102,819

(22) PCT Filed: Dec. 13, 2014

(86) PCT No.: PCT/AT2014/000221
§ 371 (c)(1),
(2) Date: Jun. 8, 2016

(87) PCT Pub. No.: WO2015/085336
PCT Pub. Date: Jun. 18, 2015

(65) Prior Publication Data

US 2016/0312518 A1 Oct. 27, 2016

(30) Foreign Application Priority Data

Dec. 13, 2013 (AT) ..... A 957/2013

(51) Int. Cl.
*E06B 3/16* (2006.01)
*E06B 1/16* (2006.01)
(Continued)

(52) U.S. Cl.
CPC ..... *E06B 3/16* (2013.01); *E06B 1/16* (2013.01); *E06B 1/325* (2013.01); *E06B 3/822* (2013.01);
(Continued)

(58) Field of Classification Search
CPC ... E06B 5/161; E06B 5/16; E06B 3/16; E06B 3/822; E06B 3/22; E06B 3/962; E06B 2003/7046; E06B 1/325
See application file for complete search history.

(56) References Cited

U.S. PATENT DOCUMENTS 2,524,961 A * 10/1950 Cramer, Jr. ..... F01B 17/04 254/104
2,914,817 A * 12/1959 Jackson ..... E06B 1/52 49/380
(Continued)

FOREIGN PATENT DOCUMENTS

DE 648571 8/1937
DE 4432580 11/1995
(Continued)

OTHER PUBLICATIONS

International Search Report for PCT/AT2014/000221, English translation attached to original, Both completed by the European Patent Office dated May 28, 2015, All together 7 Pages.

*Primary Examiner* — Justin B Rephann
(74) *Attorney, Agent, or Firm* — Sughrue Mion, PLLC

(57) ABSTRACT

A device for closing a building opening, wherein a planar closure element and/or a frame rigidly attached to the edge of the building opening has a frame profile, which by way of two lateral surfaces delimits a profile cavity that is open toward the rebate face, wherein from each of the two lateral surfaces, a profile wall projects toward the direction of the respective other lateral surface. On the projecting profile walls, a metal cover plate and a clamping part are attached such that they are pulled together by screws, with the interposition of the profile walls. On the two projecting profile walls, a clamping part abuts, in each case, both flanks of a groove, the opening surface of which is parallel to the connecting surface between the two projecting profile walls.

10 Claims, 20 Drawing Sheets

(51) Int. Cl.

| | |
|---|---|
| *E06B 1/32* | (2006.01) |
| *E06B 3/82* | (2006.01) |
| *E06B 5/16* | (2006.01) |
| *E06B 3/70* | (2006.01) |

(52) U.S. Cl.
CPC ..... *E06B 5/161* (2013.01); *E06B 2003/7046* (2013.01)

(56) References Cited

U.S. PATENT DOCUMENTS 3,107,113 A 10/1963 Sconzo
3,112,817 A 12/1963 Critchfield
3,171,632 A * 3/1965 Jines ..... F16M 7/00 254/104
3,844,084 A 10/1974 Hubbard et al.
4,076,438 A * 2/1978 Bos ..... E06B 3/982 403/297
4,467,562 A * 8/1984 Hemmerling ..... E05D 15/063 49/411
4,497,148 A * 2/1985 Lopez ..... E04B 1/617 52/126.3
4,713,922 A * 12/1987 Ingold ..... E06B 1/6069 254/104
6,119,411 A * 9/2000 Mateu Gil ..... E04B 1/94 109/80
6,327,826 B1 * 12/2001 Mann ..... E06B 5/161 52/1
6,745,526 B1 * 6/2004 Autovino ..... E06B 3/74 52/232
8,397,450 B1 * 3/2013 Neal ..... E06B 1/6023 52/204.1
8,490,347 B2 * 7/2013 Valler ..... E06B 3/16 52/204.1
8,850,762 B2 * 10/2014 Knauf ..... E05B 65/006 52/217
2003/0208970 A1 * 11/2003 Saelzer ..... E06B 1/6084 52/167.1
2005/0034387 A1 * 2/2005 Bourly ..... E06B 3/16 52/204.5
2007/0137124 A1 * 6/2007 MacDermott ..... E04B 2/745 52/278
2007/0256363 A1 * 11/2007 Hord ..... E05C 3/042 49/381
2008/0222963 A1 * 9/2008 Zwart ..... E05B 47/00 49/503
2008/0289547 A1 * 11/2008 Wakamatsu ..... E06B 5/11 109/76
2009/0241465 A1 * 10/2009 Majors ..... E06B 1/30 52/784.11
2010/0139187 A1 * 6/2010 Medina ..... E06B 1/12 52/204.1
2010/0219648 A1 * 9/2010 Watson ..... E05F 7/005 292/343
2011/0061308 A1 * 3/2011 Badger ..... E06B 3/822 49/501
2011/0194886 A1 * 8/2011 Wu ..... E06B 3/9641 403/23
2011/0233358 A1 * 9/2011 McPheeters ..... E04D 13/1476 248/231.41
2012/0279166 A1 * 11/2012 Valler ..... E06B 3/16 52/656.2
2013/0056612 A1 3/2013 Cheng
2013/0064600 A1 * 3/2013 Tseng ..... E06B 3/9682 403/205
2013/0074444 A1 * 3/2013 Baumert ..... E06B 1/603 52/784.11
2013/0081332 A1 * 4/2013 Baumert ..... E06B 1/02 49/397
2014/0047785 A1 * 2/2014 Wilkinson ..... E06B 3/827 52/232
2014/0370215 A1 * 12/2014 Collison ..... B32B 5/26 428/36.2

FOREIGN PATENT DOCUMENTS

| | | |
|---|---|---|
| DE | 19509206 | 9/1996 |
| DE | 19733415 | 2/1998 |
| DE | 29812574 | 11/1998 |
| DE | 19848570 | 3/2000 |
| DE | 19860217 | 4/2000 |
| DE | 19931171 | 1/2001 |
| EP | 0695846 | 2/1996 |
| EP | 1020605 | 7/2000 |
| EP | 1138864 | 10/2001 |
| FR | 2846354 | 4/2004 |
| GB | 2478754 | 9/2011 |
| WO | 2010001170 | 1/2010 |

* cited by examiner

DEVICE FOR CLOSING AN OPENING IN A BUILDING

CROSS-REFERENCE TO RELATED APPLICATION

This application is the U.S. national phase of PCT Application No. PCT/AT2014/000221 filed on Dec. 13, 2014, which claims priority to AT Patent Application No. A957/2013 filed on Dec. 13, 2013, the disclosures of which are incorporated in their entirety by reference herein.

The invention relates to a device which comprises a frame and a flat closure element and which serves for closing a building opening, wherein the flat closure element and/or the frame which is fastened rigidly to the inner surface of the building opening has a construction profile which comprises a cavity, which is open toward the hinge side, on three sides.

In this document, the expression "hinge side" refers to the surfaces oriented at least approximately normal to the plane of the flat closure element, at which surfaces, when the wall opening is closed, flat closure elements face toward one another or the flat closure element and frame face toward one another.

In the context of this document, a "flat closure element" is typically a window leaf or a door leaf, regardless of the manner in which the mobility thereof is guided, that is to say for example regardless of whether, in the case of a door, it is a pivoting door, folding door, sliding door, sectional door, sliding and folding door, etc.

Documents DE19509206 A1, DE19931171 A1, DE29812574 U1, EP1020605 A2 and DE19733415 B4 present leaves, in the form of so-called "all-glass leaves", of pivoting doors or windows. Here, two glass panes which are arranged in parallel with one another and with a spacing from one another are adhesively bonded to one another with the interposition of a spacer profile which runs along the edge of both panes. Furthermore, here, that side of the spacer profile which remains free is equipped with a so-called fitting groove. A so-called "fitting groove" (a standardized design thereof is, in technical circles, also sometimes referred to as "Eurogroove") is known in particular in the case of window construction profiles. It is a shallow groove which may have an opening area which is constricted by projections from the groove flanks. The fitting groove serves for slidingly guiding push rods in the case of turn/tilt-and-turn type windows and for facilitating the positioning of fittings, or of bores and milled-out portions for said fittings, in the directions normal to the window plane. It generally does not serve to eliminate the need for drilling and milling work.

DE 198 60 217 A1 presents a pivoting door, which is intended for use as a household door, in the case of which the door leaf is composed of a rectangular panel-like core composed of an insulating material, a for example metal profile construction, and two outer layers, wherein the profiles of the profile construction have a groove which is open toward the hinge side. The profile construction runs around the core on the end faces thereof. The outer surfaces run on both sides of the core and profile construction, in parallel with the common plane thereof, and are adhesively bonded both to the core and to the profile construction, such that a stable sandwich is formed. At the opening area of the groove of the profile construction, which groove is open toward the hinge side, there projects from each of the two groove flanks in each case one short profile wall oriented normal to the groove flanks. In intended use, hinge fitting parts or a lock can be fastened in said groove. The profile walls which project from the groove flanks presumably serve as a fastening aid. On the underside of the door leaf, the groove is closed off by way of a cladding strip to prevent the ingress of dirt. To realize high stability of the pivoting door which is proposed for use as a household door, the profiles of the profile construction are of very large dimensions and are covered by the outer layers of the door leaf and thus adhesively bonded. For use as automatically closing and opening fire protection doors, the construction is nevertheless not stable enough.

High mechanical loads on a pivoting door arise not only owing to the weight thereof or if it has to withstand a brake-in. An extreme usage situation with regard to the frequency of occurrence and severity of the mechanical loads is that of pivoting doors which, owing to safety requirements, must have an automatic closing and opening mechanism, such as is typically the case with fire protection doors, in particular in the case of two-leaf fire protection doors. In the case of such doors, the most intense mechanical load consists in that, under standardized tests, they must perform five hundred thousand to one million automatically triggered opening and closing cycles without interruption, without even a single part or a single connection failing to such an extent that the function is no longer reliably performed. (The exact number of test cycles is dependent on country-specific standards.) Two-leaf pivoting doors as fire protection doors have not only closing sequence regulation, which must have the effect that the overlying leaf (active leaf) is always reliably closed after the underlying leaf (inactive leaf), but also opening sequence regulation, which must have the effect that, when the inactive leaf is opened, the active leaf is imperatively also opened at least as far as the minimum opening angle beyond which it is ensured that the closing sequence regulation functions reliably. In particular, during the test of the opening sequence regulation, in the case of which the inactive leaf is opened by an external actuating device and, accordingly, by way of a transmission mechanism installed in the door, the active leaf is automatically opened together with said inactive leaf at least as far as said minimum opening angle, extremely high forces briefly also act on individual fitting parts owing to lever ratios which are unfavorable (close to a dead center) in some opening angle ranges.

Specifically in the case of such doors, numerous fitting parts have to be attached in and on the frame and on the leaves, such that the possibility of fast, easy and flexibly adjustable installation of fitting parts in profile grooves without the need for separate bores or milled-out portions would be economically highly desirable. Owing to the difficulties that arise from the described mechanical requirements, this has however hitherto not been possible in a satisfactory manner.

The main problem on which the invention is based consists in proposing a design for a closable building opening in the form of a window, door or gateway, wherein the movable closure element(s) and/or the frame rigidly fastened to the inner surface of the building opening have a construction profile, the cross-sectional area of which comprises a cavity, which is open toward the hinge side, on three sides. In relation to known designs in which such a cavity is provided, the design to be realized is intended to permit the following combination of improvements, with good economic efficiency and without the need to accept aesthetic disadvantages:

The cavity which is open toward the hinge side should be able to have such a large cross-sectional area that all required fittings can fit therein without the need for the construction profile to be drilled or milled.

The design should make it possible to realize such high mechanical strength that, accordingly, it is also possible to construct pivoting doors with high mechanical load such as in particular fire protection doors with automatic opening and closing sequence regulation, specifically without it being necessary to form a sandwich from construction profiles and outer surfaces of a door leaf for this purpose.

An important secondary problem is that of achieving that the work outlay for the production of the movable closure elements and of the frames is low.

To solve the problems, a design is taken as a starting point in which a construction profile delimits a cavity, which is open toward the hinge side, by way of three delimiting surfaces which are arranged in approximately U-shaped fashion with respect to one another in cross section, wherein, from each of the two side delimiting surfaces, there projects a profile wall which locally narrows the width of the cavity in the cross-sectional view, wherein fitting parts can be fastened to the projecting profile walls with the aid of a clamping part, by virtue of the projecting profile walls being clamped in between and by virtue of the clamping part and fitting part bridging the cavity between the two projecting profile walls.

As an improvement according to the invention, it is proposed that the connection between the clamping part and projecting profile walls, and/or the connection between the fitting part and projecting profile walls, be designed such that it blocks, in form-fitting fashion, relative movement between the projecting profile walls away from one another and toward one another. To realize said form-fitting blocking action, the contact geometry between projecting profile walls and the clamping part and/or fitting part is designed such that, on the two projecting profile walls, the clamping part and/or the fitting part bears in each case against both flanks of a groove which is formed on each of the projecting profile walls and the opening area of which is parallel to the connecting surface between the two projecting profile walls.

In a particularly preferred embodiment, said groove on the projecting profile walls is designed such that the spacing between the flanks of said groove at the region against which the clamping part and/or the fitting part bear narrows with increasing groove depth. Thus, a play-free form fit between the construction profile and the clamping part and/or fitting part can be achieved in a particularly straightforward and reliable manner.

In a further particularly preferred embodiment, the cross-sectional area of the construction profile has no closed hollow chambers. Advantages that can be achieved by this relate to producibility, fire protection and connectability to parts which are arranged on that side of the construction profile which is averted from the opening side of the cavity.

The significance of the invention is clear in particular from the numerous applications in which the design according to the invention yields considerable advantages or which are actually made possible in the first place by way of the design according to the invention. Aside from the basic principle of the invention, a number of such exemplary applications will therefore be depicted and described below.

The invention, including advantageous further developments thereof, will be discussed in more detail on the basis of somewhat stylized drawings of advantageous exemplary embodiments, and new applications made possible by these:

Figure 1:
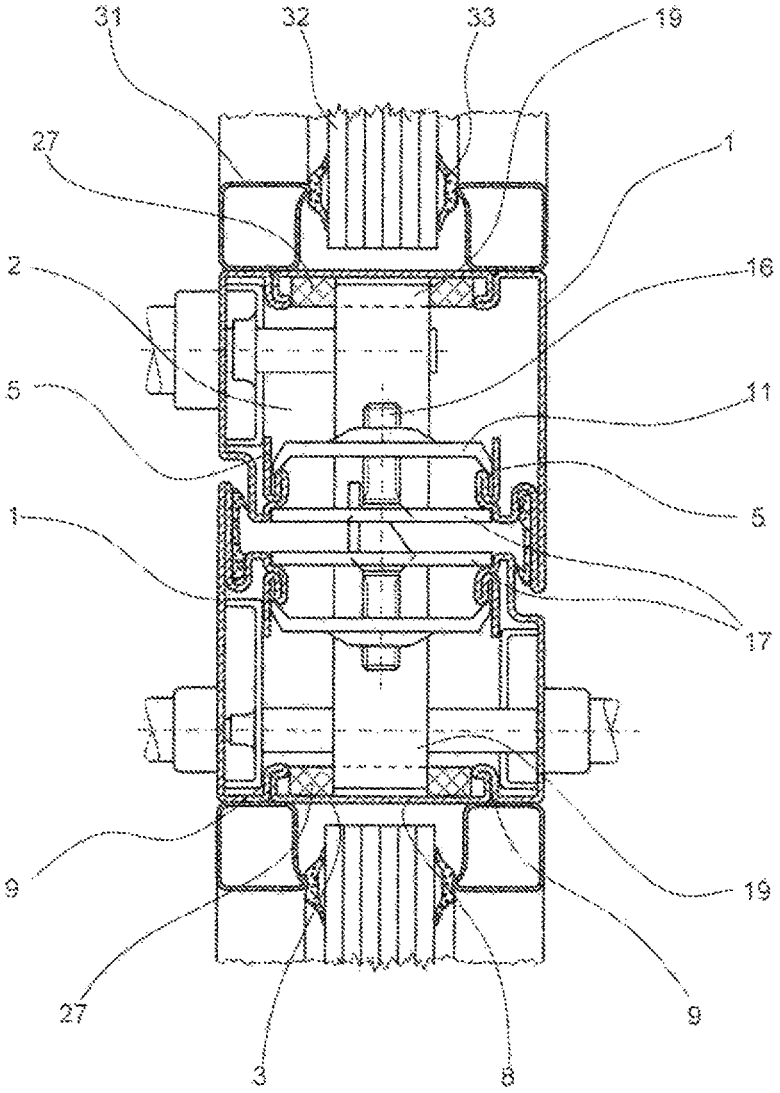
FIG. 1 shows, in a horizontal sectional view, two edge regions, facing toward one another, of exemplary leaves, designed according to the invention, of a two-leaf pivoting door.

FIG. 1 shows the mutually facing regions of two pivoting door leaves which, aside from the fittings, are formed from a glass pane 32 and from a construction which surrounds said glass pane and which is formed from construction profiles 1 and glass strips 31.

Figure 2:
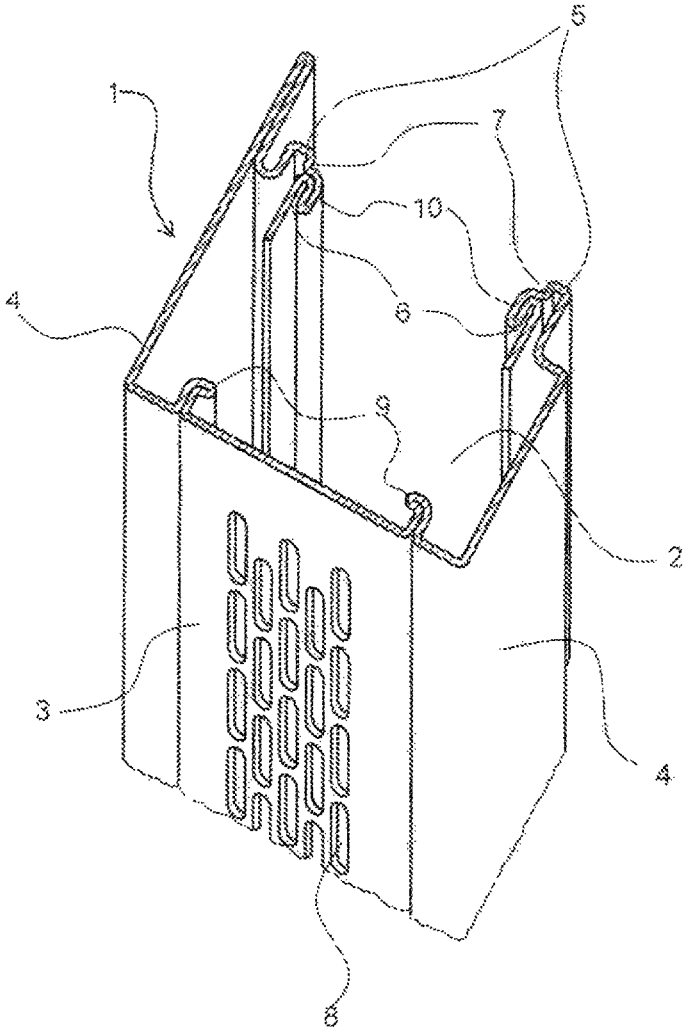
FIG. 2 shows, in an oblique view, the construction profile according to the invention used in the leaves of FIG. 1.

The construction profile 1 is typically formed from sheet steel by roll forming. Details of the construction profile 1 can, in part, be seen more clearly in FIG. 2 than in FIG. 1. Said construction profile has substantially a U-shaped cross-sectional shape, and, as such, surrounds the profile cavity 2 on three sides in a cross-sectional view, wherein the open side of the profile cavity is oriented in each case toward the hinge side, that is to say toward the other construction profile 1 in the case of FIG. 1.

In the example illustrated in FIG. 1, the glass pane 32 of each pivoting door leaf is held on the construction profiles 1 by being clamped along its edges in each case between two glass strips 31, with the interposition of an elastic sealing profile 33. The glass strips 31 are also profiles which are typically formed by roll forming and seam welding of a sheet-steel strip. The glass strips 31 bear in each case against the outer face of the base surface 3 (FIG. 2) of a construction profile 1 and are connected to the construction profile 1.

Typically, the connection between a glass strip 31 and a construction profile 1 is formed by virtue of screws extending from the cavity 2 of the construction profile 1 through the base surface 3 of said construction profile, and through the abutting wall of the glass strip 31, into the profile cavity of the glass strip 31. In this way, a secure and detachable connection is formed without fastening elements being visible from the outside. For space reasons, and for ease of handling, it has proven to be advantageous here for the construction profile 1 to not be a hollow profile.

Close to the opening area of the cavity 2, at the same height above the base surface 3 of the construction profile 1, a profile wall 5 projects from each of the two lateral surfaces 4 (FIG. 2) of the construction profile 1 toward the cavity 2, such that the width of the cavity 2 is, in the height region of the two profile walls 5, narrowed in relation to the width in adjacent height regions.

FIG. 1 furthermore shows the installation, according to the invention, of a fitting 19 in a construction profile 1, wherein, in this example, the fitting 19 is a lock case. The fitting 19 is arranged substantially in the cavity 2. Said fitting is rigidly connected to a cover plate 17 which, on that side of the profile walls which is averted from the base surface 3 of the construction profile 1, bears against said profile walls and thus covers the cavity 2.

At that side of the profile walls 5 which faces toward the base surface 3 of the construction profile 1, a clamping part 11 bears against the profile walls 5. A screw 16 bears by way of its head against the outer side of the cover plate 17. The threaded bolt of the screw 16 runs through a bore in the cover plate 17 and is in threaded engagement with a threaded bore in the central part 12 (FIG. 3) of the clamping part 11. By way of the tensile force exerted by the screw 16, the cover plate 17 and clamping part 11 are pushed together. The cover plate 17 and clamping part 11 are supported, so as to be prevented from moving toward one another, by the profile walls 5 against which they bear, such that the clamping part 11 and cover plate 17 exert, from opposite sides, a compressive force on in each case one projection 10 (FIG. 2) of the profile walls 5, said compressive force being equal in overall magnitude to the tensile force of the screw 3.

It is of major importance according to the invention that the contact surfaces between the clamping part 11 and profile walls 5 of the construction profile 1 are not simply planar surfaces oriented normal to the screw 16, but rather that the clamping part 11, with its two edge regions 13 which project in relation to its central part 12 toward the profile walls 5, bears in each case against both flanks of in each case one groove 6 (FIG. 2), the groove base of which bears against a profile wall 5 and the opening area of which is oriented toward the base surface 3 of the construction profile 1 and the width of which at the contact region with the clamping part 11 increases continuously from the groove base toward the opening area.

By way of this design, it is achieved that the clamping part 11 realizes a secure, play-free and form-fitting blockage of relative movements of the two side surfaces 4 of the construction profile 1 toward one another and away from one another. Said effect is also enhanced by the fact that the cover plate 17 is also held in form-fitting fashion, so as to be prevented from being displaced laterally relative to the construction profile 1, by virtue of in each case one wall region of a profile wall 5 bearing frontally against both lateral face walls of the cover plate 17, because the cover plate 17 bears against the profile walls 5 in each case in a corner region 7, at which a surface parallel to the base surface of the construction profile 1 transitions into a surface averted therefrom and approximately normal thereto.

The construction profile 1 that is illustrated would, in itself, be capable of being relatively easily deformed such that its two side surfaces 4 are bent toward one another or away from one another. By way of the described arrangement of clamping parts 11, said softness is corrected, such that the construction profile 1, in those longitudinal regions on which clamping parts 11 are arranged, is of similar stiffness and strength to a closed hollow profile.

By way of the invention, it is thus possible, even for doors with extremely high mechanical demands, to provide lightweight and slim construction profiles 1 which have a cavity 2 which is open toward the hinge side and in which fittings 19 can be conveniently accommodated, and which are moreover of single-walled form, that is to say without a hollow chamber, so as to be easy to produce and, if necessary, easy to machine. Clamping parts 11 have to be installed, as illustrated, only on those longitudinal regions of the construction profiles 1 at which high mechanical loads are to be expected. If necessary, as a complementary part to a clamping part 11, use may also be made of a cover plate 17 which is not connected to a fitting 19 but which is simply merely a plate which presses against the profile walls 5, from the side situated opposite the clamping part 11, owing to the force of screws 16.

In the advantageous embodiment illustrated in FIG. 1, the fitting 19 is, additionally to its retention on the cover plate 17, also held by a plate 27 so as to be prevented from moving normally to the plane of the construction formed from the construction profiles. For this purpose, the plate 27 is clamped between profile walls 9 which project into the profile cavity 2 from the base surface of the construction profile 1, and the fitting 19 is inserted into a milled-out portion in the plate 27.

Figure 3:
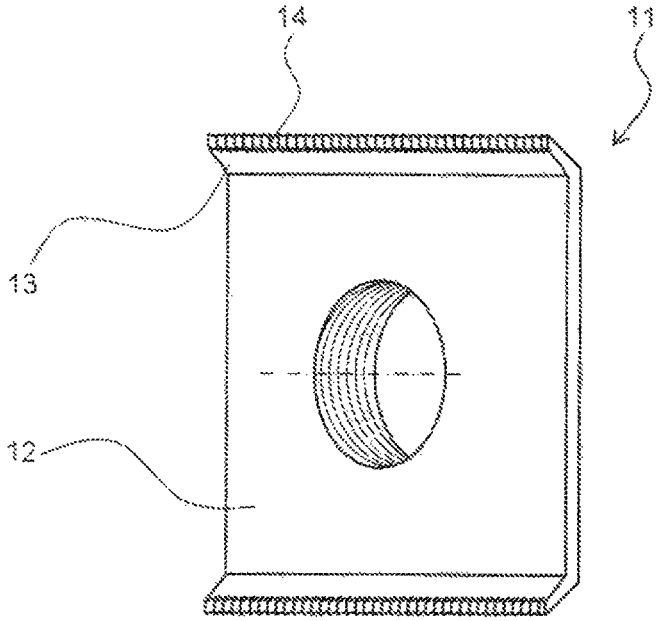
FIG. 3 shows, in an oblique view, an exemplary clamping part according to the invention as used in the example as per FIG. 1.

As can be seen in FIG. 3, it is advantageous for the projecting edge regions 13 of the clamping part 11, by way of which said clamping part bears, during intended use, against grooves 6 of the construction profile 1, to be equipped with a toothing 14 such that, in the intended arrangement of the clamping part 11 on a construction profile 1, elevations and depressions alternate with one another, in the profile direction of the construction profile 1, on the contact surface of an edge region 13 with delimiting surfaces of the groove 6. Owing to the force with which the toothing 14 of the clamping part 11 is pressed into the groove 6, the tips of the toothing are pushed into the material of the construction profile 1, whereby the clamping part 11 is also held in form-fitting fashion on the construction profile 1 so as to be prevented from slipping in the profile direction.

Figure 4:
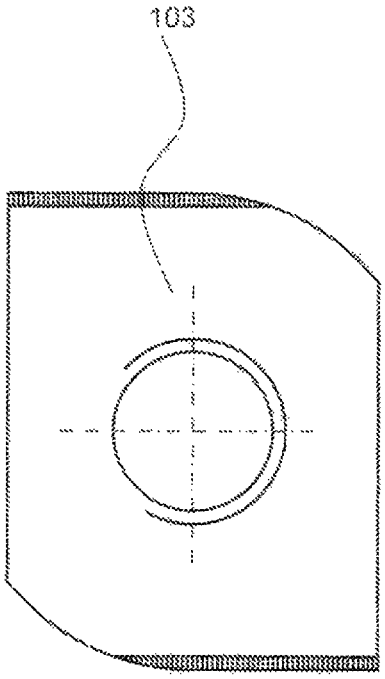
FIG. 4 shows, in a front view, a further clamping part according to the invention.

FIG. 4 shows a design of a clamping part 103 the edge regions of which, which are intended to be placed in engagement with a construction profile, are rounded at diagonally opposite end regions. The clamping part 103 is more convenient to install than the clamping part 11, because, for intended mounting in the profile cavity of the relevant construction profile, it only needs to be pivoted about the axis of its threaded bore, and not about an axis normal thereto. This is important in particular if further objects are already arranged in the profile cavity, such that little space is available.

Figure 5:
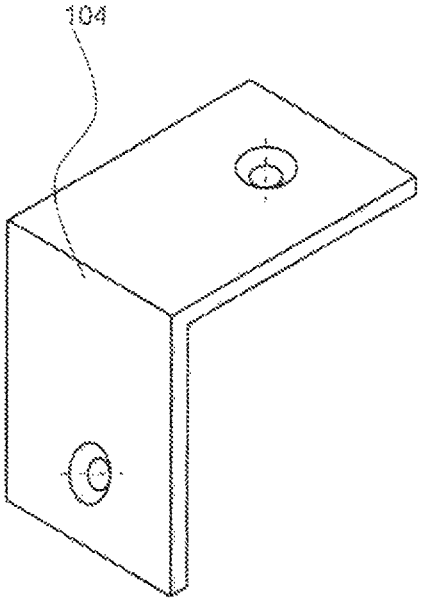
FIG. 5 shows, in an oblique view, an exemplary corner angle piece for the connection of two construction profiles according to the invention across a miter surface, wherein the two limbs of the corner angle piece each constitute a cover plate.

FIG. 5 shows, in an oblique view, an exemplary corner angle piece 104 for the connection of two construction profiles according to the invention across a miter surface. Here, as in the case of the cover plate 17 as per FIG. 1, the two limbs of the corner angle piece 104 are intended to bear against profile walls of the construction profiles which are to be clamped, and are intended to be pressed by way of clamping part 11, 103 and screw 16 against the respective profile walls. By contrast to the cover plate 17 of FIG. 1, the limbs of the corner angle piece 104 bear only against those longitudinal regions of the respective profile walls which adjoin the miter surfaces. The corner connection is easy to realize in terms of installation and is highly stable.

Figure 6:
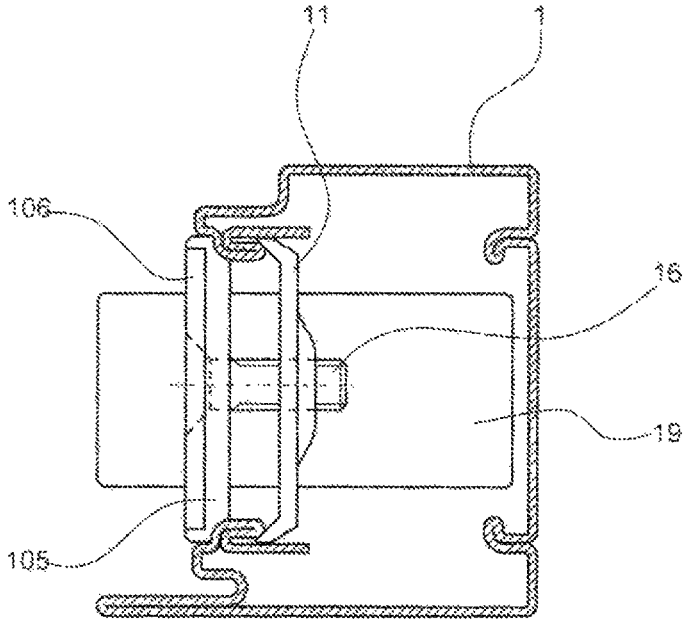
FIG. 6 shows, in a sectional view, the installation, according to the invention, of a fitting into a construction profile using a heat insulator on the cover plate.

In the case of the installation according to the invention, as depicted in FIG. 6, of a fitting 19 in a construction profile 1, the cover plate 106, which is connected to the fitting 19, bears against the construction profile 1 not directly but with the use of an intermediate insulation layer 105 composed of a thermally insulating, preferably also heat-resistant, material.

Figure 7:
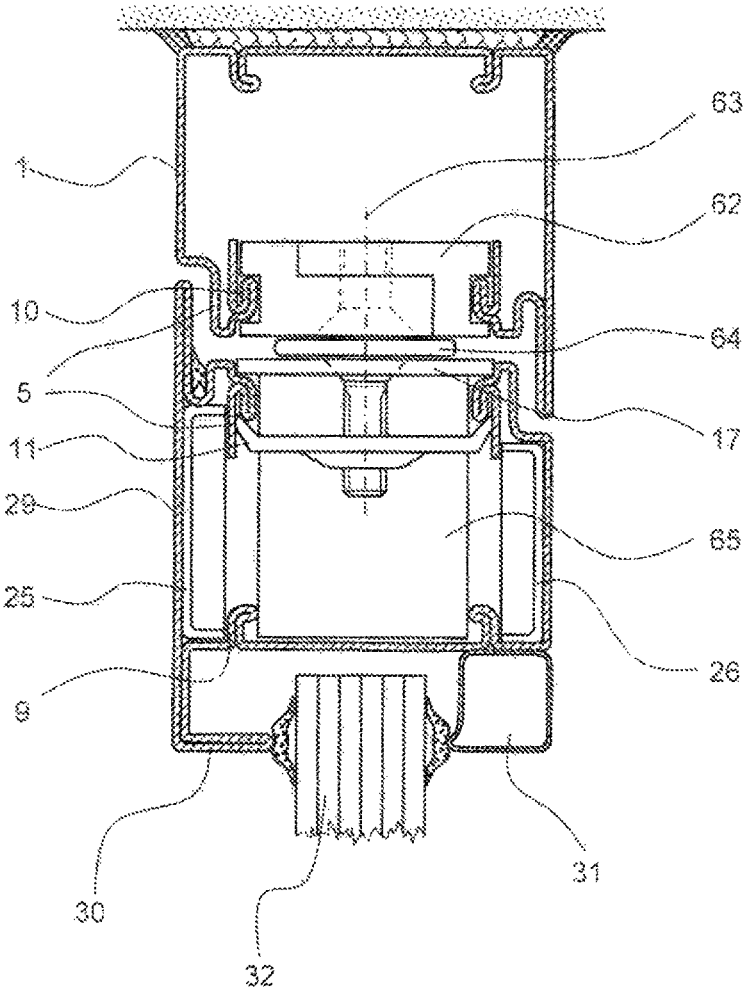
FIG. 7 shows, in a vertical sectional view, an exemplary design according to the invention in the application with a slide-rail-type door closer.

FIG. 7 depicts, by way of example, the way in which a construction profile 1 designed according to the invention can be used as a slide rail for a sliding block 62 of a slide-rail-type door closer.

In accordance with the functional principle, known per se, of slide-rail-type door closers, a sliding block 62 which is mounted so as to be linearly displaceable along the upper door frame part (formed by a construction profile 1) is connected via a pivotable arm 64 to a rotary drive 65 which is held on the upper edge of the pivoting door leaf so as to be positionally fixed relative thereto and which exerts, on the pivotable arm 64, a torque about an axis parallel to the pivot axis of the door leaf. (A reversed design is also possible, in which a sliding block which is mounted so as to be linearly displaceable along the upper edge of the door leaf is connected by way of a pivotable arm to a rotary drive which is arranged positionally fixedly on the upper door frame part.) By way of a design as depicted in FIG. 7, a construction profile 1 designed according to the invention can perform the function of the slide rail, which is otherwise in the form of a separate part. For this purpose, the sliding block 62 extends between the profile walls 5 which project from the side surfaces 4 of the construction profile 1 (FIG. 2), and said sliding block is for this purpose provided, on each of its two side surfaces, with a groove into which in each case one projection 10 of a profile wall 5 projects, such that the grooves on the sliding block 62 act as sliding-guide grooves, with the projections 10 being parts complementary thereto.

With regard to installability, it is advantageous for the sliding block 62 to be formed, as depicted, from two parts which each extend only over approximately half of the width of the fitting groove and which are connected by way of screws 63 for the first time during installation on the construction profile 1.

In a logical use of the present inventive concept, it is also the case in FIG. 7 that the rotary drive 65 of the slide-rail-type door closer, on which the second end of the pivot arm 64 is held, is held in the cavity of a further construction profile 29 according to the invention. The fastening of the rotary drive 65 in the construction profile 29 is realized, in the same way as for the fittings 19 of FIG. 1, by way of clamping parts 11, a cover plate 17 which is connected to the rotary drive 65, and by means of screws which press the cover plate 17 and clamping parts 11 together, such that they clamp between them a part of the profile walls which project from the side walls of the construction profile 29. In the example of FIG. 7, the construction profile 29 forms the upper construction part of a pivoting door leaf. In this way, a visually extremely inconspicuous design of a slide-rail-type door closer is realized. The use of a separate slide rail is rendered unnecessary. Furthermore, highly simple installation is possible, with which, moreover, very good adjustability with regard to the position of the rotary drive 65 along the associated construction profile 29 is realized.

FIG. 7 also depicts a possible way in which adjacent construction profiles 29 of a door leaf construction or of a frame can be connected to one another. For this purpose, two so-called corner clamping angle pieces 25, 26 are provided. Said corner clamping angle pieces 25, 26 are each composed of two identical profile limbs which are connected to one another at an angle of 90°. The cross-sectional areas of the profile limbs are dimensioned such that, on the construction profile 29, said limbs can each be inserted, with the formation of an interference fit, into an undercut groove, such that they become stuck therein without play. In the advantageous embodiment illustrated in FIG. 7, the base surface of each undercut groove forms in each case the inner face of a side wall of the construction profile 29. The corner clamping angle pieces 25, 26 are held, so as to be prevented from moving away from said base surface, by a profile wall 9 which projects from the base surface of the construction profile 29 and by the profile wall 5 against which that clamping part 11 which serves for the fastening, according to the invention, of fittings in the construction profile 29 also bears.

The construction profile 29 as per FIG. 7 differs from the construction profile 1 predominantly discussed above in that it has a profile wall 30 which projects from that side of the base surface which is averted from the cavity, and said profile wall can perform the function of a glass strip, such that, per construction part piece, only a single separate glass strip 31 is required.

Figure 8:
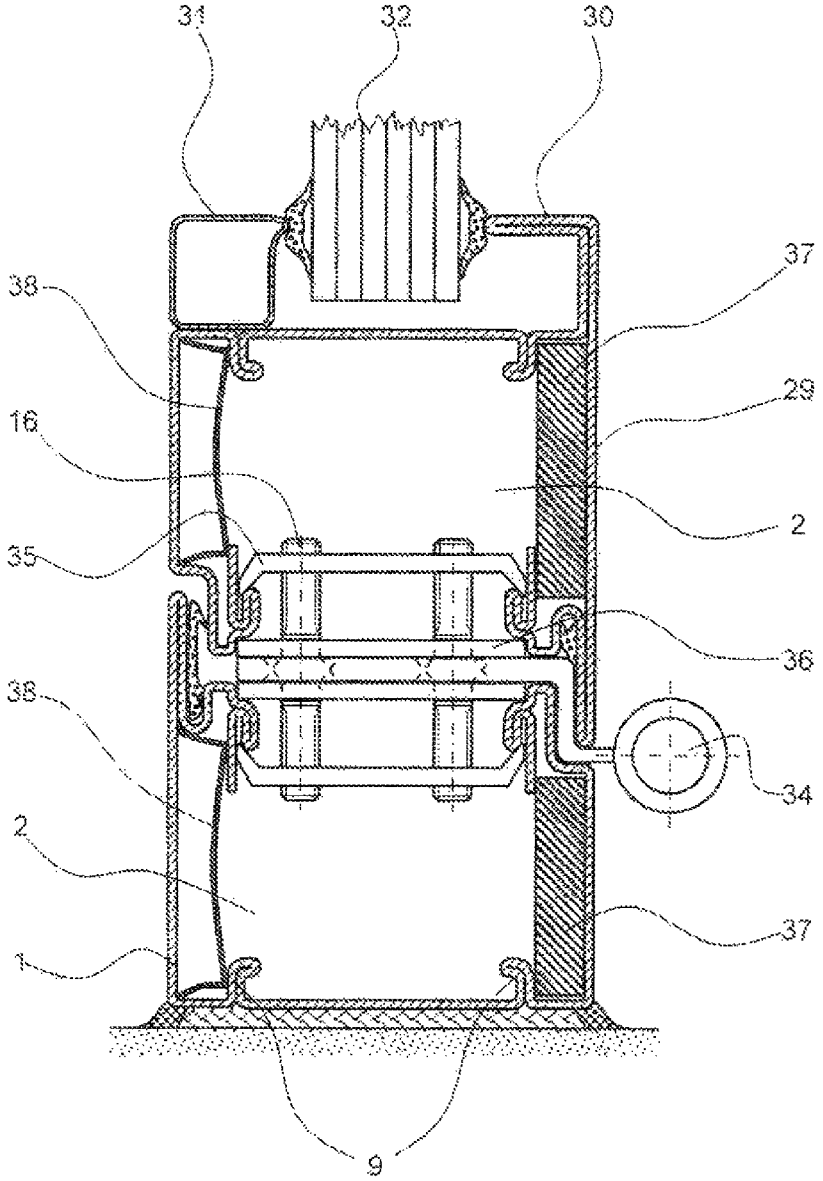
FIG. 8 shows, in a horizontal sectional view, the hinge region of an exemplary pivoting door designed according to the invention, which is additionally equipped with heat shields and fire protection bodies.

FIG. 8 shows—inter alia—the connection, designed according to the invention, of hinged parts to a pivoting door leaf and the associated, positionally fixed frame. Construction profiles 1 form the door frame. Construction profiles 29 (with integrally formed profile wall 30, which serves as a glass strip) form the construction of the pivoting door leaf, which is in the form of a glass leaf. The shaft 34 about which the pivoting door leaf is pivotable relative to the frame is situated in front of the space enclosed by the construction profiles 1. Holding arms arranged one above the other project from the shaft 34 into the adjacent hinge side between the pivoting door leaf and frame, and are connected there, by way of screws 16, to in each case one cover plate 36 and one clamping part 35 on the respective construction profile 1 and 29. Owing to the particularly high loads to be expected in this case, the cover plates 36 and the clamping parts 35 are connected to one another by way of in each case two connecting screws 16, rather than just one as in the case of the cover plates 17 and clamping parts 11 in the examples discussed above. In this case, too, the arrangement is visually inconspicuous, easy to install and detachably fastenable at any desired position along the longitudinal direction of the construction profiles 1, 29, without the need for any bores or milled-out portions for this purpose.

FIG. 8 furthermore shows how the construction profiles 1, 29 can be "upgraded" so as to have improved fire protection characteristics.

At the in each case left-hand side of the cavity of the construction profile 1, 29 in question, there is clamped a heat shield 38. In this case, said heat shield has the shape of a flat U-shaped profile, wherein the free limbs bear against the side wall of the construction profile 1, 29 in question, and thus the base of the flat U-shaped profile is arranged at a spacing from the side wall of the construction profile 1, 29 in question. The free ends of the limbs of the U-shaped profile which forms a heat shield 38 are preferably equipped with a toothing such that they make contact with the construction profile 1, 29 not linearly but by way of a series of contact points, because in this way, heat conduction between the two parts is reduced. The heat shields 38 serve primarily for preventing heat from being radiated from one side surface of the cavity 2 of the construction profile 1, 29 to the other side surface. A particular advantage of the illustrated embodiment is that the heat shields 38 can also be retroactively inserted into the construction profiles 1 from the open side of the cavity 2—that is to say from the hinge side—and clamped.

At the in each case right-hand side of the cavity of the construction profile 1, 29 in question, there is inserted in each case a fire protection body 37. Said fire protection body 37 has the shape of a rectangular profile. It is composed of a heat-resistant, thermally insulating material, based for example on mineral wool or silicate. By contrast to the heat shield 38, said fire protection body not only deflects thermal radiation but also very greatly slows heat conduction.

By arranging different types, different thicknesses and different numbers of heat guard articles in the hollow chamber 2 of a construction profile 1, 29, the construction profile 1, 29 can be easily adapted in modular fashion to different fire protection classes such as F30, F60, F90 etc. This yields highly valuable economic advantages with regard to production and installation logistics.

For the clamping of fire protection body 37 and heat shield 38 for prevention of movement normal to the construction plane of the construction formed by the construction profiles 1, 29, fire protection body 37 and heat shield 38 are in each case clamped between a side surface of the construction profile 1, 29 and further profile walls, wherein one of said further profile walls projects inward from the base surface of the construction profile; in the case of the construction profile 1, this is the profile wall 9.

In the construction profiles 1, 29 themselves, heat conduction is possible only through the base surface 3 (FIG. 2) from one side surface 4 (FIG. 2) to the other side surface 4. Said heat conduction can be very greatly slowed by virtue of the base surface 3 being provided with a pattern of apertures 8, as can be clearly seen in FIG. 2, such that the cross-sectional area for heat transfer by heat conduction in the material of the construction profile 1 is reduced, and the transfer path is lengthened. It is particularly advantageous for the apertures 8, as illustrated, to be elongated holes, the longitudinal direction of which is parallel to the profile direction, and for multiple rows of elongated holes to be situated adjacent to one another with a longitudinal offset with respect to one another by in each case one half of the pattern dimension.

For the production of the apertures 8, it is highly advantageous for the construction profile 1 to have a single base surface 3, and not for example multiple base surfaces which enclose one or more hollow chambers. In this way, it is specifically possible for the apertures 8 to be easily formed by being punched out. In the case of hollow chambers, it would instead be necessary to perform milling, which entails a very much longer machining time and very much higher costs.

Figure 9:
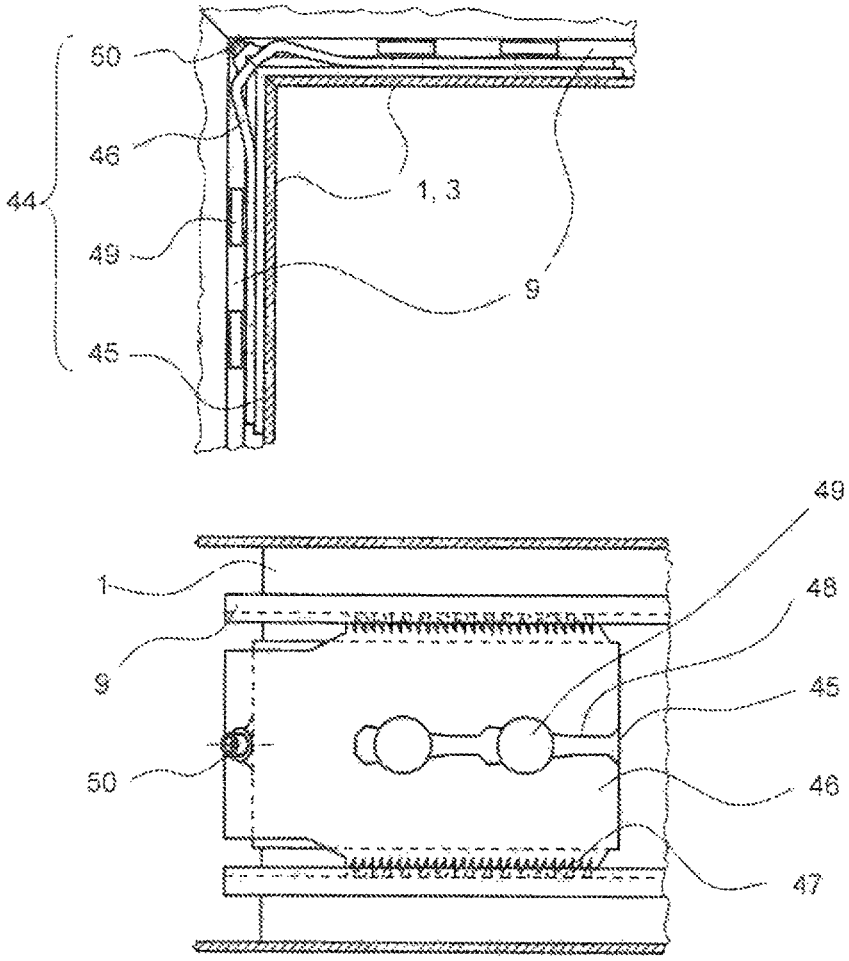
FIG. 9 shows, in a horizontal and in a vertical partial sectional view, an advantageous form of the corner connection between two construction profiles used in accordance with the invention.

FIG. 9 shows, in two views, an advantageous design for connecting two construction profiles 1, which can be used in accordance with the invention, in a mitered configuration so as to form a construction for a door area or a window area. For this purpose, use is made of a corner clamping fitting 44 which is composed of four different components:

The supporting angle piece 45 is composed of two planar rectangular sheet-metal pieces which are connected to one another along in each case one short end face and which are at right angles to one another. In the cavity of the construction profiles 1 which bear against one another in a mitered configuration, the supporting angle piece 45 bears against the base surfaces 3 of said construction profiles.

Against the outside of the supporting angle piece 45 there is a further angle piece, the so-called tension angle piece 46. It, too, is composed substantially of two planar sheet-metal rectangles which are connected to one another along their short end faces and which are at right angles to one another. The lateral end faces of the tension angle piece 46 are equipped with a toothing 47, the tips of which each bear against a profile wall 9 of a construction profile 1.

A screw 50 runs through a nut-type threaded bore in the tension angle piece 46. Said nut-type threaded bore runs through the tension angle piece 46 and is diagonal with respect to the two limbs thereof. The screw 50 presses, by way of its inner end face with respect to the tension angle piece 46, against the boundary region between the two angle piece limbs of the supporting angle piece 45 situated at the inside. When screwed further toward the supporting angle piece 45, the screw has the effect that the tension angle piece 46 is pulled approximately diagonally away from the supporting angle piece 45.

Spreading bolts 49 are rigidly connected to the limbs of the supporting angle piece 45. Said spreading bolts are approximately of circularly symmetrical mushroom shape and project from the limbs of the supporting angle piece 45 into the elevated angle piece region between said limbs, and run in each case through an elongate aperture 48, running in the limb direction, on the respectively adjacent limb of the tension angle piece 46. The width of the aperture 48 decreases with increasing spacing from the connecting surface between the two limbs of the tension angle piece 46, and here, also becomes narrower than the diameter of the spreading bolts 49 in their longitudinal region running through the aperture 48.

The screwing of the screw 50 toward the supporting angle piece 45 causes the limbs of the tension angle piece 46 to be displaced on the supporting angle piece 45 toward the connecting line between the limbs thereof. In this way, longitudinal regions of the aperture 48 at which the width of the aperture, in the case of a non-deformed tension angle piece 46, is smaller than the diameter of that longitudinal part of the spreading bolts 49 which runs through the aperture reach spreading bolts 49. This has the effect that parts of the tension angle piece 46 situated at both sides of the aperture 48 of the tension angle piece 46 are spread apart from one another, and the toothings 47 are pressed firmly against the profile walls of the construction profiles 1, and thus the construction profiles 1 are, together with the tension angle piece 46, displaced relative to the supporting angle piece 45 toward the miter surface between the two construction profiles 1.

The assembly of the miter connection can thus be performed in an extremely straightforward manner. It is furthermore advantageous that the construction profiles 1 do not have to be milled out or drilled for this purpose, and that the cavities 2 (FIG. 2) in adjacent construction profiles 1 remain substantially open toward one another. In this way, if necessary, it is possible for lines or cables to be easily guided in the construction profiles 1 even across construction corners, and it is possible for heat shields and insulating material to be attached in the cavities 2 even at the corner region of construction profiles 1. For the attachment of heat shields and insulating material, it is particularly advantageous that—as shown—tension angle piece 46 and supporting angle piece 45 extend only between the two profile walls 9 and not as far as the side surfaces 4 of the construction profiles.

Figure 10:
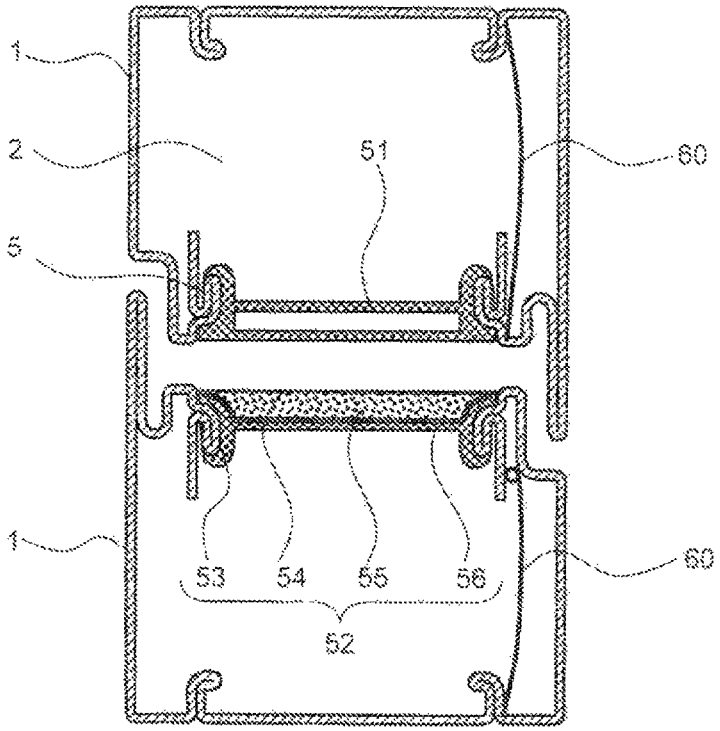
FIG. 10 shows, in a sectional view, the arrangement of heat guard components and concealment profiles in construction profiles used in accordance with the invention.

FIG. 10 depicts two versions of concealment profiles 51, 52 for the profile cavity 2 of construction profiles 1 that can be used in accordance with the invention, which concealment profiles are each intended to be clamped on the two projecting profile walls 5 and bridge the spacing between the profile walls 5 so as to cover the profile cavity 2.

Here, the concealment profile 51 is a simple plastics extruded profile or a metal profile. It has primarily a visual function.

By contrast, the concealment profile 52 has not only the visual function but also a fire protection function and, for this purpose, is constructed from multiple different parts: the carrying profile 53 is a plastics extruded profile, and serves as a carrier for the other parts and is clamped to the projecting profile walls 5. Said carrying profile has a profile cavity which, at the hinge side, is concealed by a very thin profile wall 54. In the profile cavity there is arranged a fire protection swelling agent 55. In the event of a fire, the profile wall 54 melts away and the fire protection swelling agent 55 swells, whereby it absorbs energy and, in an intended manner, closes the gap between the two construction profiles 1. That delimiting wall of the profile cavity in the carrying profile 53 which is averted from the hinge side is concealed by a sheet-metal strip 56. This—by contrast to the carrying profile 53—maintains its stability even in the event of a fire and prevents the fire protection agent 55 from swelling in the wrong direction.

Two further forms of heat shields 60 are also depicted in the right-hand part of the profile cavities 2 of the construction profiles 1 in FIG. 10. Said heat shields are also, like the heat shields 38 in FIG. 8, typically formed by sheet-metal strips.

Figure 11:
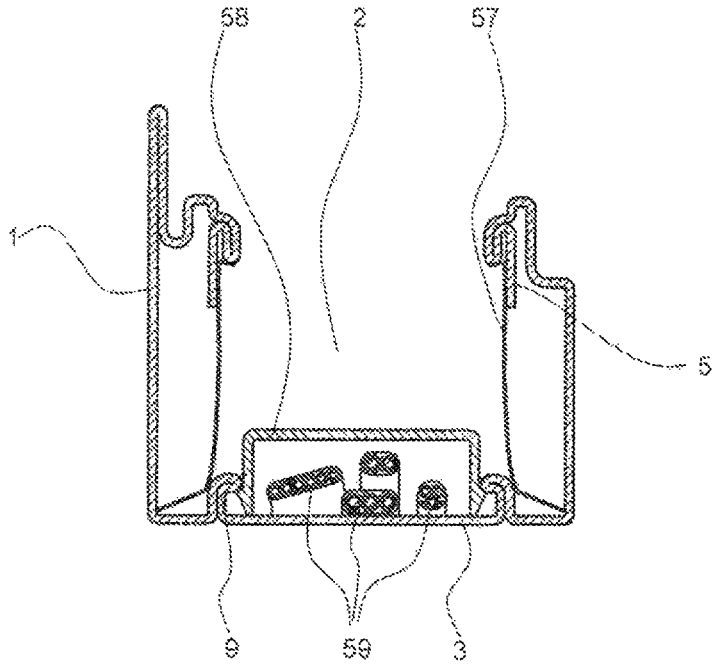
FIG. 11 shows, in a sectional view, the arrangement of heat guard components, cables and a cable channel in a construction profile used in accordance with the invention.

FIG. 11 shows, in the case of a construction profile 1 for use in accordance with the invention, further insert components in the profile cavity 2. Two further versions of heat shields 57 composed of sheet metal and clamped in the profile cavity 2 are depicted at the sides. A cable channel profile 58 in the form of a flat U-shaped profile is clamped between two profile walls 9 which project into the profile cavity 2 from the base surface 3 of the construction profile 1 and which are curved toward one another in hook-shaped fashion in the profile. The cable channel profile 58 is typically a plastics extruded profile. It bears against the construction profile 1 at the profile walls 9 by way of its free limb ends which are in the form of detent tips and which, between the profile walls 9, are bent toward one another slightly in relation to their relaxed position. The cable channel profile 58 conceals cables 59 with respect to the outer part of the profile cavity 2 of the construction profile 1.

Figure 12:
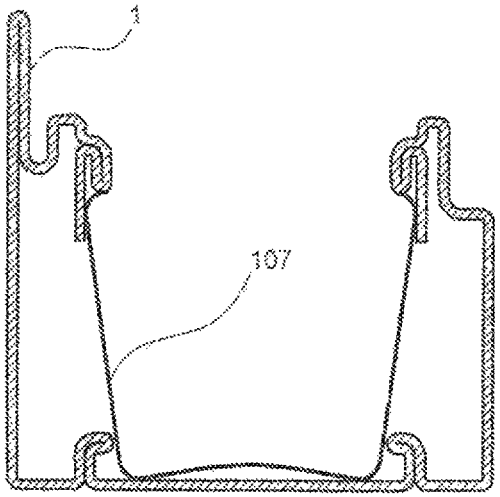
FIG. 12 shows, in a sectional view, a further heat shield in a construction profile according to the invention.

FIG. 12 shows the design and installation situation for a clamping profile 107 in a construction profile 1, wherein the clamping profile 107 acts as a twofold heat shield. The clamping profile 107 is typically composed of sheet steel and has approximately a U-shaped cross-sectional shape, wherein the limbs are obliquely apart slightly, and wherein, in the elastically relaxed state, the free ends of the limbs bridge a spacing slightly greater than the spacing between those walls of the construction profile 1 against which said limb ends are intended to bear in the installed state. Thus, in the installed state, the free ends of the limbs of the clamping profile 107 bear under elastic preload against the construction profile 1 and thereby hold the clamping profile 107 without play in the construction profile 1 in force-fitting fashion. The base surface of the clamping profile 107 runs close to the base surface of the construction profile 1, though it is ideally—as depicted—arched away from said base surface slightly. Analogously to the apertures 8 of the construction profile 1 of FIG. 2, the base surface of the clamping profile 107 may have a pattern of apertures for impeding heat conduction.

The clamping profile 107, which constitutes a twofold heat shield, can be installed particularly quickly; it can however be installed only at longitudinal regions at which no clamping part according to the invention is to be attached.

Figure 13:
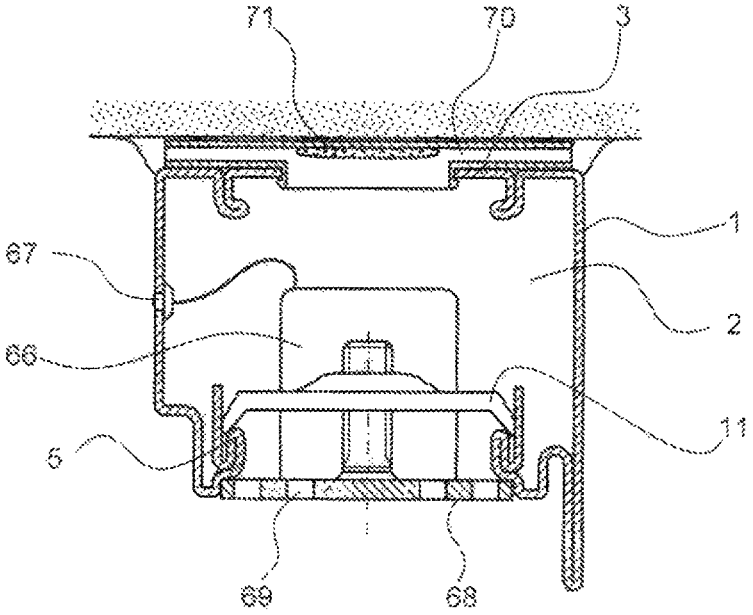
FIG. 13 shows, in a sectional view, the arrangement of a smoke detector in a construction profile used in accordance with the invention.

FIG. 13 shows, on a construction profile 1 which is used in accordance with the invention as a construction part of a frame of a door, the installation of a smoke detector 66 which must function only when the door leaf is open. The central part of the smoke detector 66 is situated in the profile cavity 2 of the construction profile 1 and, for this purpose, is connected to a cover plate 68 and, according to the invention, is fastened together with said cover plate to projecting profile walls 5 of the construction profile 1 by way of a clamping part 11, as already described further above on the basis of other fittings. In the example illustrated, the smoke detector 66 is connected via a cable to an LED display 67 which is inserted into a bore in a side surface of the construction profile 1 so as to be visible from the outside. In order that smoke can reach the smoke detector 66 in the first place, the cover plate 68 has slots 69 extending through it, and the seal which is situated between the construction profile 1 and the building wall to which the construction profile 1 is fastened locally has ducts extending through it which lead from the two spacings which are separated by the construction profile 1, through an opening in the base surface 3 of the construction profile 1, into the profile cavity 2 of the construction profile 1. In the example illustrated in FIG. 13, to realize the seal and ducts, a flat hollow body 70 which has at least three openings is arranged between construction profile 1 and the adjacent building wall. In the hollow body 70 there is arranged a fire protection swelling agent 71 which, in the event of a fire, swells under the action of heat and closes the ducts of the hollow body 79.

Figure 14:
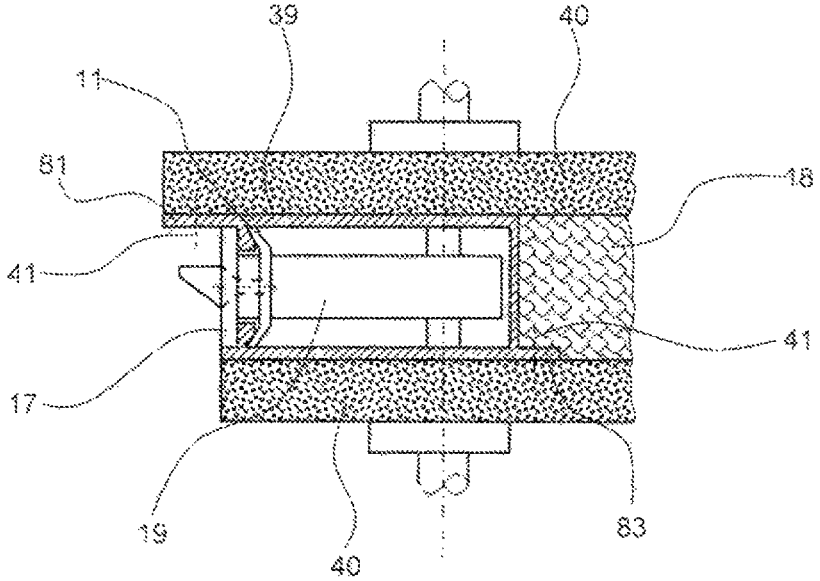
FIG. 14 shows, in a sectional view, a design according to the invention on a door leaf composed of wood.

FIG. 14 shows a construction profile 39, which is used in accordance with the invention, on a door leaf which has two outer layers 40 which are typically composed of wood and which laterally cover the construction profile 39. In that space region between the two outer layers which is not occupied by construction profiles 39, there is arranged a panel-like core 18 which is composed, for example, of a heat-insulating material. In the illustrated advantageous embodiment, one lateral wall of the construction profile 39 is, by way of a profile wall 81, elongated toward the hinge side beyond the mere bordering of the profile cavity, and the second lateral wall of the construction profile 39 is, by way of a profile wall 83, elongated away from the hinge side beyond the mere bordering of the profile cavity. Through the profile walls 81, 83, the outer layers 40 can be screwed by way of screws 41 to the construction profile 39, wherein the screws 41 penetrate the outer layers 40 from the side averted from the visible side, which is self-evidently advantageous from a visual aspect.

Figure 15:
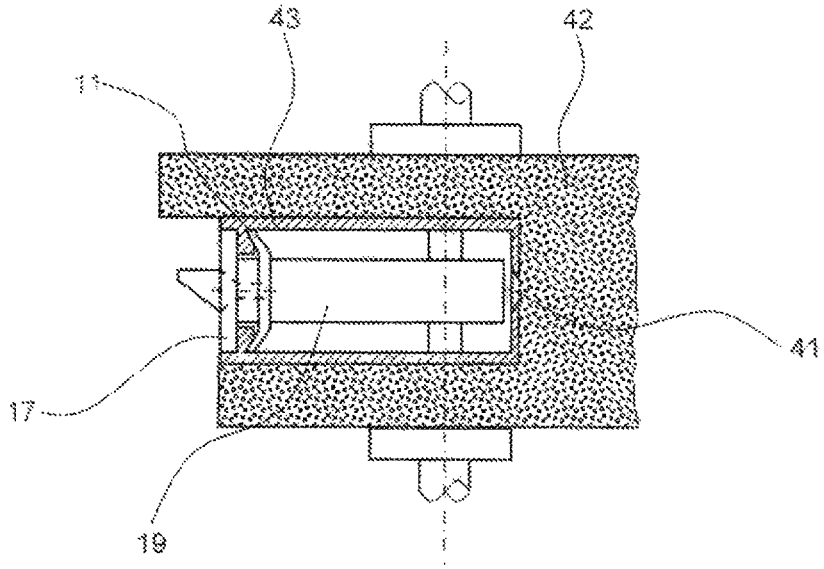
FIG. 15 shows, in a sectional view, a design according to the invention on a further door leaf composed of wood.

FIG. 15 shows a construction profile 43 used in accordance with the invention on a door leaf 42 which is formed substantially as a thick wood panel, in the end faces of which there is milled a groove and into which there is inserted, at each end face, a construction profile 43. In this case, construction profiles 43 and wood panel may be connected to one another by way of screws 41 which run through the base surface of the construction profile 43 from the profile cavity of the construction profile 43.

Figure 16:
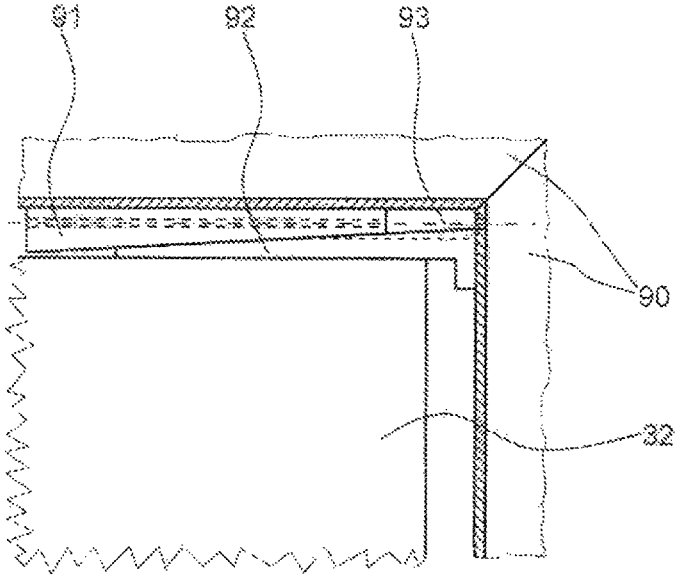
FIG. 16 shows, in a partial sectional view, with a section plane parallel to the door leaf plane, an advantageous arrangement of a block arrangement on a door leaf designed according to the invention.

FIG. 16 shows an advantageous type of attachment for an adjustable block arrangement on a movable flat closure element, for example a glass door, which comprises construction profiles 90 according to the invention and a core (glass pane 32). In the case of an example of a pivoting door, the adjustable block arrangement is optimally attached to that end of the upper end face of the core which is averted from the pivot axis of the door. The block arrangement is composed of two acute-angled wedges 91, 92 and of a screw 93, wherein the two wedges 91, 92 are arranged at the corner region of two construction profiles 90, in the gap between the base surface of the horizontal construction profile 90 and the end face of the core (glass pane 32). The wedges 91, 92 bear against one another by way of in each case one of the two wedge faces thereof. By way of the second wedge face, one wedge 91 bears against the base surface of the construction profile 90 and the second wedge 92 bears against the end face of the core. The screw 93 runs through a bore in the base surface of the vertical construction profile 90 into a nut-type bore on one wedge 91. By virtue of the screw 93 being tightened, the wedge 91 is pulled toward the vertical construction profile 90, whereby the total thickness of the block arrangement as formed by the sum of the thicknesses of the two wedges 91, 92 increases, and thus the horizontal construction profile 90 is lifted in relation to the core. For the variation of the thickness of the block arrangement, it is merely necessary, with the door open, for the possibly provided concealment of the profile cavity of the upper part of the lock-side vertical construction profile 90 to be removed, and for the head of the screw 93, which head is situated in the profile cavity, to be rotated by way of a screwdriver. By contrast to conventional designs of block arrangements, it is thus not necessary to remove a glass strip in order to change the thickness of the block arrangement, and the associated handling of the seal material to be arranged between the glass strip and glass pane is also eliminated.

Figure 17:
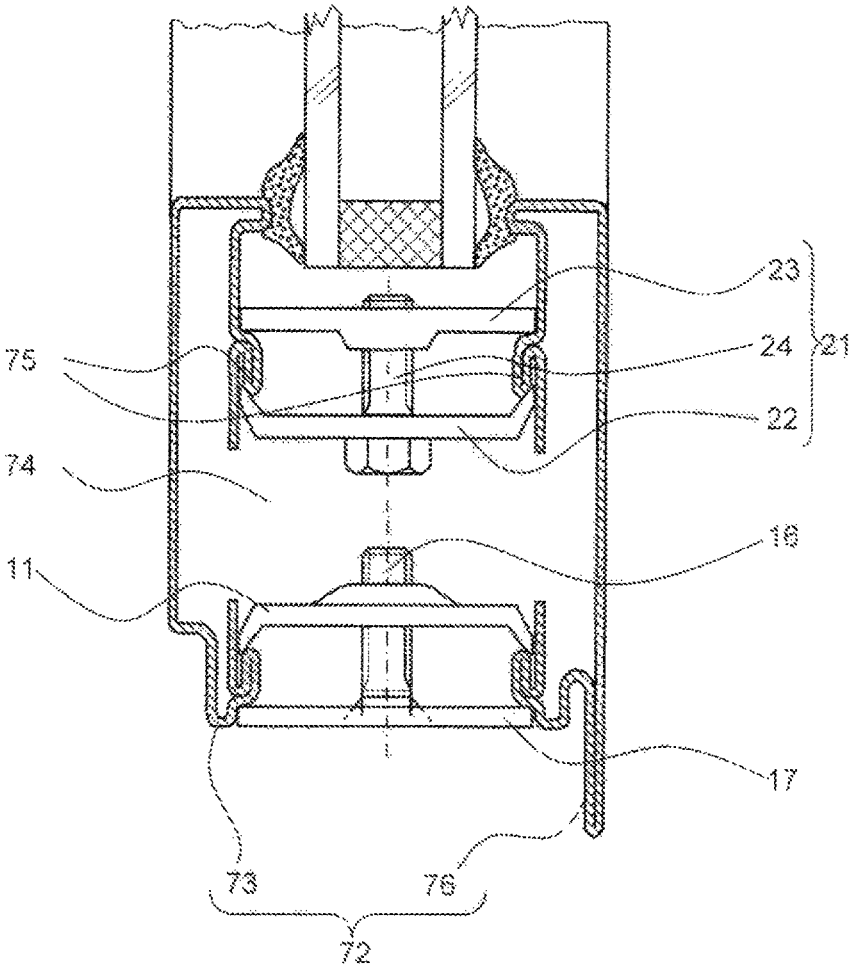
FIG. 17 shows, in a sectional view, and on a door leaf, the use of a construction profile used in accordance with the invention, said construction profile being formed from two separate profile parts.

FIG. 17 shows, in a profile view, for example on a glass door leaf, the use of a construction profile 72 used in accordance with the invention, which construction profile is formed from two separate profile parts 73, 76. The two profile parts 73, 76 form substantially the side surfaces of the profile 72, which between them enclose the profile cavity 74.

As in the example of FIG. 1, on the side facing toward the hinge side, the profile cavity 74 is bridged by a clamping part 11, a cover plate 17, and a screw 16 which pulls said clamping part and cover plate together, in that two profile walls of the construction profile 72 which project beyond the profile cavity 74 are clamped between clamping part 11 and cover plate 17.

Instead of the otherwise provided base surface of the construction profile, there is arranged, on that side of the profile cavity 74 which is averted from the hinge side, a series of multiple screw connections 21 which function as already described on the basis of FIG. 1. Said screw connections each have a clamping part 22, a counterpart plate 23 and a screw 24, wherein the screw 24 pulls the clamping part 22 and the counterpart plate 23, in which a nut-type thread is situated, together, and edge regions of clamping part 22 and counterpart plate 23 in each case clamp a projecting profile wall 75 of a sub-profile 73, 76 between them. For reasons relating to the installation sequence, the screw connection 21 is oriented such that the head of the screw 24 that is required is arranged in the profile cavity 74, and not outside the profile cavity, as in the case of the screw connection as per FIG. 1.

The design with two sub-profiles 73, 76, which are locally connected to one another for forming a construction profile 72 offers material savings and better modularity than designs with a monolithic construction profile, and eliminates the need for separate glass strip profiles. The design however also leads to reductions in strength and work outlay during the installation process. The design may be expedient in particular if doors or windows are required in the case of which particular, only very seldomly arising construction thicknesses are required.

Figure 18:
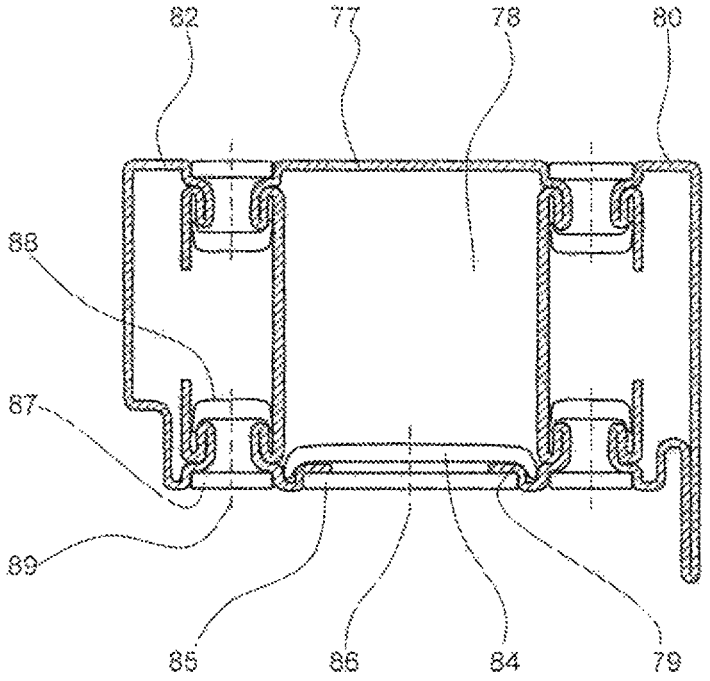
FIG. 18 shows, in a sectional view, a construction profile which can be used in accordance with the invention and which has laterally doubled-up additional profiles.

FIG. 18 shows a construction profile which can be used in accordance with the invention and which is formed as a composite of three sub-profiles 77, 80, 82 arranged in parallel with respect to one another. The central profile 77 is substantially in the form of a U-shaped profile in which the free limb ends are curved inward, that is to say beyond the profile cavity 78, and are connected to one another, in the manner already described, by way of screw connections which are formed in each case from a clamping part 84, a cover plate 85, and a screw 86. The side surfaces of the central profile 77 however also each have two outwardly projecting wall regions. By way of said outwardly projecting wall regions, the side surfaces of the central profile 77 are connected by way of further screw connections according to the invention, which are formed in each case from a clamping part 88, a cover plate 87 and a screw 89, to in each case one further sub-profile 80, 82.

Said design is particularly advantageous if, for adaptation to different requirements of insulation and/or fire protection classes, a high level of modularity is required.

Figure 19:
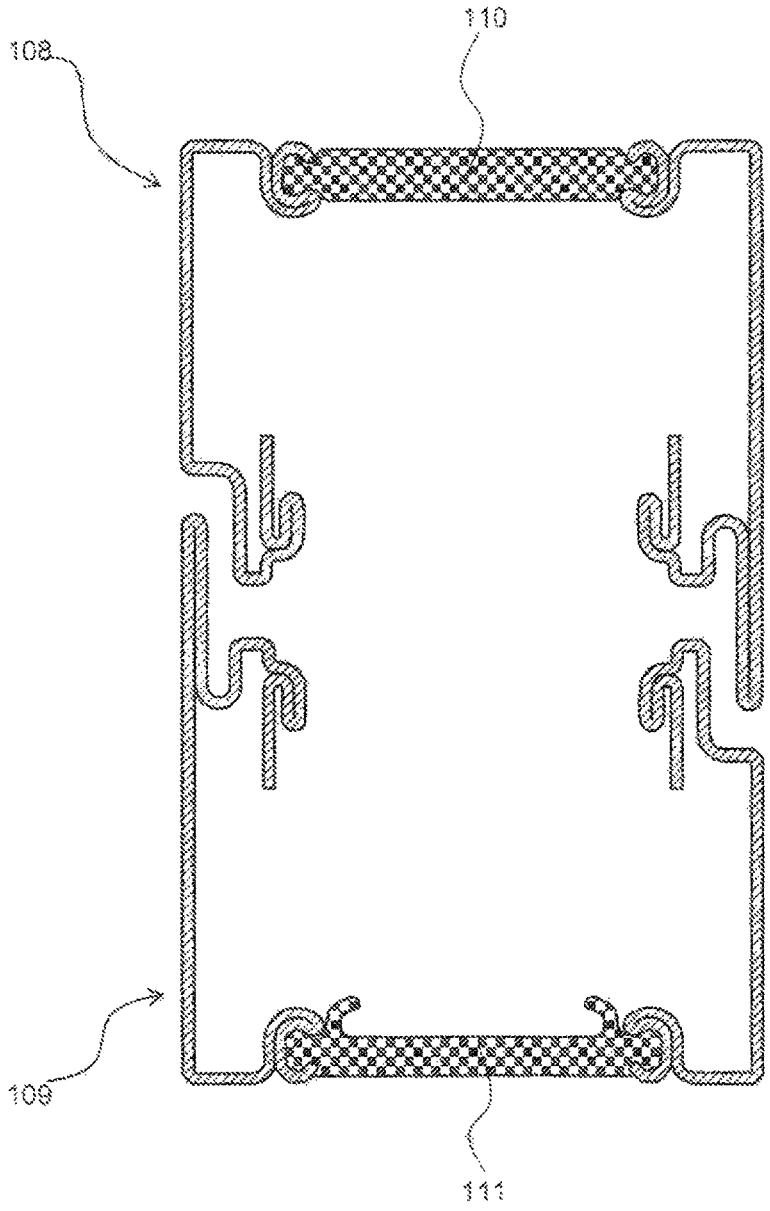
FIG. 19 shows, in a sectional view, two construction profiles which can be used in accordance with the invention and which are each formed from a composite profile composed of three sub-profiles, wherein the central profile in each case is formed from a thermally insulating material.

FIG. 19 shows, in a sectional view, construction profiles 108, 109 which can be used in accordance with the invention and which are each formed, for the purposes of heat insulation, from three sub-profiles. The lateral sub-profiles are, in the conventional manner, composed of metal, typically of rolled sheet steel in the example illustrated. The central sub-profiles 110, 111 are composed of a material which exhibits significantly poorer heat conductivity than metal, such as in particular plastics material or a composite material composed of non-metal fibers and a plastics material. The individual sub-profiles are clamped together, that is to say mutually engaging by way of individual profile wall surfaces, such that a wall region of a sub-profile is encompassed by wall regions of the adjacent sub-profile oriented in parallel therewith. Here, in the connecting region, the sub-profiles preferably bear against one another under elastic compressive preload. The sub-profile (110, 111) composed of the lower-strength and elastically softer material is preferably that sub-profile of which a wall region is encompassed by wall regions of the adjacent profile. If the metal, lateral sub-profiles are formed from sheet metal by roll forming, the central, heat-insulating sub-profile (110, 111) may be connected already during the roll-forming process. If the metal, lateral sub-profiles are aluminum extruded profiles, the connection is realized by virtue of the central sub-profile being retroactively pressed in.

Figure 20:
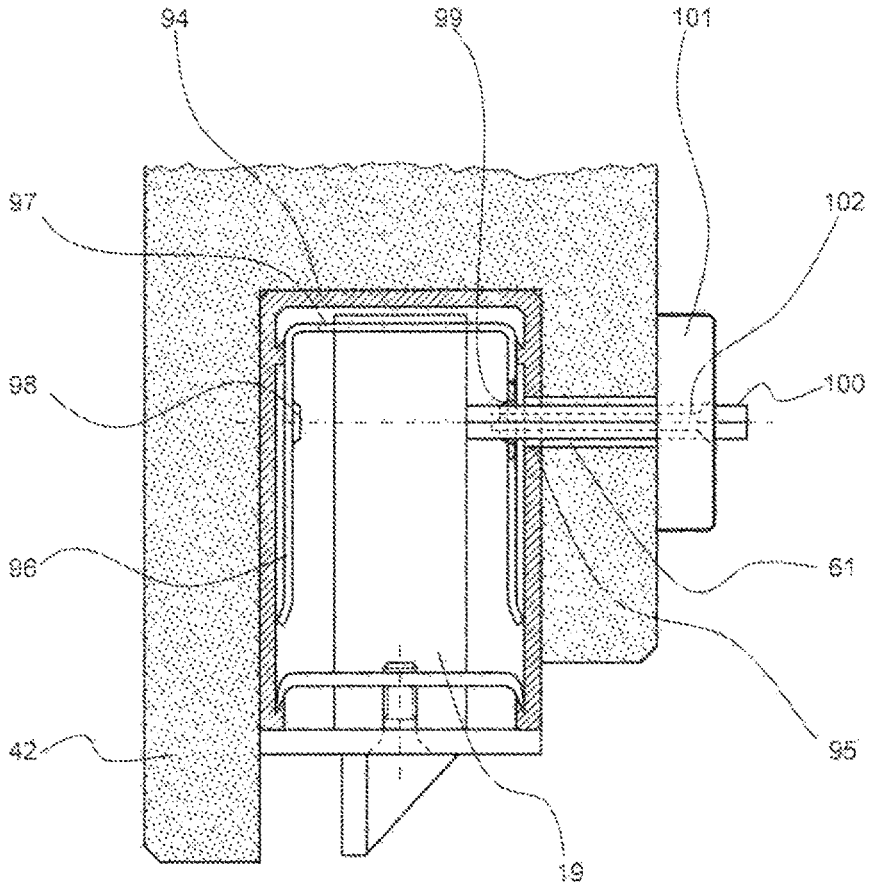
FIG. 20 shows, in a profile view, an advantageous installation configuration for a handle and lock case in a construction profile used in accordance with the invention.

FIG. 20 shows, based on the example of a door leaf 42 composed of solid wood in which a construction profile 94 is used in accordance with the invention, a highly advantageous installation configuration for a fitting 19, formed by a lock case 19, and the associated handle rosette 101.

The lock case 19 is arranged in the construction profile 94 and is fastened thereto according to the invention, as already described on the basis of FIG. 1, by way of a cover plate, a clamping part and a screw. In addition to the lock case 19, a holding part 96 is arranged in the construction profile 94. The holding part 96 is typically composed of sheet steel; it is for example in the shape of a U-shaped profile and, as such, is arranged in the construction profile 94 so as to be parallel thereto, wherein the outwardly curved free end regions of the profile limbs thereof are, in the elastic region, bent together slightly in relation to their relaxed position, such that they thus bear under pressure against the inner face of the side surfaces of the construction profile 94 and thus hold the holding part 96 in force-fitting but not form-fitting fashion in the construction profile 94. The lock case 19 projects through a recess 97 in the base surface of the holding part 96. The handle shaft 100 (commonly a square profile) projects, from the lock case 19, normal to the plane of the door leaf 42 through an aperture 99 through a limb of the holding part 96, and through an aperture 95 through a side wall of the construction profile 94, and through an aperture 61 on the door leaf 42. The aperture 95 through the construction profile 94 and the aperture 61 through the door leaf 42 are dimensioned to be considerably wider than the cross-sectional dimensions of the handle shaft 100. The handle shaft 100 furthermore runs through a through-bore in the handle rosette 101, wherein, however, the cross-sectional dimensions of said through-bore are so narrow that the handle shaft 100 is held therein without play, so as to be prevented from moving in translational fashion normal to its longitudinal direction. From the handle rosette 101, at a spacing from the handle shaft 100, screws 102 extend through screw through-bores, of wide dimensions, in the door leaf 42 and in the construction profile 94 to threaded bores 98 on a deep-drawn region on the holding part 96.

During the installation of the arrangement, it is firstly the case that the holding part 96 is pushed into the construction profile 94. Then, in accordance with the invention as described on the basis of FIG. 1, the lock case 19 is fastened by way of a cover plate, clamping part and connecting screw to the construction profile 94, specifically in such a way that said lock case extends into the space between the limbs of the holding part 96 and projects through the recess 97 thereof, and in such a way that the handle shaft 100 can be inserted through the associated recesses on the door leaf, construction profile and holding part into the bearing receptacle, provided for the same, on the lock case 19. When the handle shaft 100 has been inserted, and the handle rosette 101 mounted thereon, the screws 102 are inserted through the screw through-bores in the handle rosette 101 and through the screw through-bores, which are of very wide dimensions for said screws, on the door leaf 42 and on the construction profile 94, into the associated threaded bores 98 on the holding part 96, and said screws are initially cautiously tightened, and here, the handle rosette 101 is fixed to the door leaf in precisely the position in which the handle shaft runs optimally, without bending and constraint, through the associated through-bore on the handle rosette. The holding part 96, which is still displaceable in the construction profile 94 in the presence of slight tension in the screws 102, slides, during the tightening of the screws 102, either automatically, or by virtue of said holding part being suitably displaced by way of a tool from the open side of the construction profile 94, approximately exactly into the optimal position in which the screws 102 are oriented normal to the door leaf plane when the handle rosette 101 is optimally positioned. If the screws 102 are now tightened with force, the handle rosette 101 is fixed exactly in the correct position, so as to be free from play for years, in order to guide the handle shaft 100 such that it is aligned, so as to be free from bending and constraint, with the associated axis of the receptacle in the lock case 19.

(In the case of designs according to the prior art, the position of the holding screws for the handle rosette relative to the door leaf is exactly predefined, whereby tolerances with regard to the position of the lock case relative to the door leaf inevitably lead to unsuitable mounting of the handle shaft, which as a further result gives rise to a poorly pivoting handle, and to destruction of pivoting mechanisms.)

The construction profiles according to the invention that have been shown and discussed are best manufactured from steel or aluminum, wherein roll forming and extrusion should be mentioned as the most important manufacturing methods. For applications in which relatively low strength requirements may exist, it may however also be advantageous for the construction profiles to be in the form of plastics extruded profiles.

The invention claimed is:

1. A device for closing a building opening, comprising:

a frame which can be fastened to an inner surface of the building opening, the frame having a construction profile which has a U-shaped cross-section so as to define a profile cavity in its longitudinal direction that has an open hinge side limited by two inner side surfaces of the construction profile, wherein the frame includes a profile wall that projects into the profile cavity from each of the two inner side surfaces;

(i) a fitting part via which a flat closure element for closing the building opening is pivotally fastened to the frame, and (ii) a clamping part are fastened to the profile walls by sandwiching the profile walls between the fitting part and the clamping part, and the fitting part and the clamping part are detachably fastened so as to be movable in the longitudinal direction along the profile cavity after detaching, characterized in that, the clamping part fits, at each of the profile walls, into a groove, the groove extending in the longitudinal direction of the construction profile and an opening of the groove extending parallel to an opening of the open hinge side, wherein, at a contact region between the clamping part and the groove, a width of the groove decreases from the opening of the groove toward a groove base thereof, each of the profile walls defines a corner portion in which the fitting part is held so as to bear against the respective profile wall in each of the corner portions and be prevented from being displaced in a lateral direction, and the clamping part fits into the groove at each of the profile walls so as to bear against two flanks of the respective groove such that, when sandwiching the profile walls between the fitting part and the clamping part, a relative movement of the profile walls with respect to one another in both an approaching and opposite direction is blocked by a play-free form lock.

2. The device as claimed in claim 1, wherein the fitting part comprises a cover plate which bears against the construction profile by way of two side surfaces, and a hinge part for pivotally fastening the flat closure element, wherein the hinge part has a holding arm which is connected to the cover plate and the clamping part.

3. The device as claimed in claim 1, wherein a portion of the clamping part which bears against the two flanks has a toothing contacting the groove.

4. The device as claimed in claim 1, wherein the U-shaped cross-section of the construction profile has no closed hollow chambers.

5. The device as claimed in claim 1, wherein the construction profile has a base surface which connects the two side surfaces and which has a pattern of apertures.

6. A device for closing a building opening, comprising:

a flat closure element for closing the building opening having a construction profile which has a U-shaped cross-section so as to define a profile cavity in its longitudinal direction, the profile cavity having an open hinge side limited by two inner side surfaces of the construction profile, wherein a profile wall projects into the profile cavity from each of the two inner side surfaces, (i) a fitting part via which the flat closure element is pivotally fastened to a frame fastenable to an inner surface of the building opening, and (ii) a clamping part are fastened to the profile walls by sandwiching the profile walls between the fitting part and the clamping part, and the fitting part and the clamping part are detachably fastened so as to be movable in the longitudinal direction along the profile cavity after detaching, characterized in that, the clamping part-fits, at each of the profile walls, into a groove, the groove extending in the longitudinal direction of the construction profile and an opening of the groove extending parallel to an opening of the open hinge side, wherein, at a contact region between the clamping part and the groove, a width of the groove decreases from the opening of the groove toward a groove base thereof, each of the profile walls defines a corner portion in which the fitting part is held so as to bear against the respective profile wall in each of the corner portions and be prevented from being displaced in a lateral direction, and the clamping part fits into the groove at each of the profile walls so as to bear against the two flanks of the respective groove such that, when sandwiching the profile walls between the fitting part and the clamping part, a relative movement of the profile walls with respect to one another in both an approaching and opposite direction is blocked by a play-free form lock.

7. The device as claimed in claim 6, wherein the fitting part comprises a cover plate which bears against the construction profile by way of its two side surfaces, and a hinge part for the pivotally fastening of the flat closure element, wherein the hinge part has a holding arm which is connected to the cover plate and the clamping part.

8. The device as claimed in claim 6, wherein a portion of the clamping part which bears against the two flanks has a toothing contacting with the groove.

9. The device as claimed in claim 6, wherein the U-shaped cross-section of the construction profile has no closed hollow chambers.

10. The device as claimed in claim 1, wherein the construction profile has a base surface which connects the two side surfaces and which has a pattern of apertures.

* * * * *